US007169087B2

(12) United States Patent
Ercanbrack et al.

(10) Patent No.: US 7,169,087 B2
(45) Date of Patent: Jan. 30, 2007

(54) CUSHIONED ELLIPTICAL EXERCISER

(75) Inventors: Gaylen Ercanbrack, Logan, UT (US); Darren Zaugg, Providence, UT (US); Kurt Finlayson, Wellsville, UT (US); William T. Dalebout, N. Logan, UT (US)

(73) Assignee: Icon Health & Fitness, Inc., Logan, UT (US)

( * ) Notice: Subject to any disclaimer, the term of this patent is extended or adjusted under 35 U.S.C. 154(b) by 401 days.

(21) Appl. No.: 10/369,207

(22) Filed: Feb. 19, 2003

(65) Prior Publication Data

US 2004/0162191 A1 Aug. 19, 2004

(51) Int. Cl.
*A63B 22/04* (2006.01)

(52) U.S. Cl. ..... 482/52; 482/51

(58) Field of Classification Search ..... 482/51, 482/52, 57, 70, 79, 80
See application file for complete search history.

(56) References Cited

U.S. PATENT DOCUMENTS

| | | | | |
|---|---|---|---|---|
| 3,824,994 | A | 7/1974 | Soderberg | |
| 3,941,377 | A | 3/1976 | Lie | |
| 5,242,343 | A | 9/1993 | Miller | |
| 5,279,531 | A | 1/1994 | Jen-Huey | |
| 5,322,491 | A | 6/1994 | Wanzer et al. | |
| 5,336,141 | A | 8/1994 | Vittone | |
| 5,383,829 | A | 1/1995 | Miller | |
| 5,562,574 | A | 10/1996 | Miller | |
| 5,577,985 | A | 11/1996 | Miller | |
| D403,033 | S | 12/1998 | Husted et al. | |
| 5,857,941 | A * | 1/1999 | Maresh et al. | 482/52 |
| 6,004,244 | A | 12/1999 | Simonson | |
| 6,007,462 | A | 12/1999 | Chen | |
| 6,123,650 | A * | 9/2000 | Birrell | 482/70 |
| 6,146,313 | A | 11/2000 | Whan-Tong et al. | |
| 6,165,107 | A | 12/2000 | Birrell | |
| 6,206,804 | B1 * | 3/2001 | Maresh | 482/52 |
| 6,217,486 | B1 | 4/2001 | Rosenow | |
| 6,277,055 | B1 * | 8/2001 | Birrell et al. | 482/52 |
| 6,500,096 | B1 * | 12/2002 | Farney | 482/52 |
| 6,551,217 | B2 | 4/2003 | Kaganovsky | |
| 6,783,481 | B2 * | 8/2004 | Stearns et al. | 482/52 |
| 6,821,232 | B1 * | 11/2004 | Wang et al. | 482/52 |
| 6,875,160 | B2 * | 4/2005 | Watterson et al. | 482/57 |
| 2004/0157706 | A1 * | 8/2004 | Miller | 482/52 |

OTHER PUBLICATIONS

Video Cassette Cover for *Tony Little's Gazelle Freestyle: Personal Trainer Video,* 2001.

* cited by examiner

*Primary Examiner*—Jerome Donnelly
*Assistant Examiner*—Tam Nguyen

(57) ABSTRACT

An exercise device having a cushioning mechanism assembly configured to absorb energy during exercise is provided. According to one aspect of the present invention, the cushioning mechanism assembly comprises a first and second biasing apparatus having a spring element configured to absorb energy by undergoing elastic deformation. According to another aspect of the present invention, a lever cushioning apparatus is provided. In one embodiment, the lever cushioning apparatus includes a lever arm and a cushioning element that functions as a fulcrum of the lever arm. In another embodiment, the cushioning element is movable along the length of the elongate member to change the amount of cushioning provided by the cushioning element. By being movable, the cushioning element allows the user to select a desired amount of cushioning during exercise.

30 Claims, 8 Drawing Sheets

CUSHIONED ELLIPTICAL EXERCISER

BACKGROUND OF THE INVENTION

1. The Field of the Invention

The present invention relates to exercise devices. In particular, the present invention relates to elliptical exercise devices having a cushioning mechanism assembly configured to absorb energy during exercise.

2. The Relevant Technology

A variety of devices have been developed to strengthen and condition leg muscles commonly used for activities such as walking, running, climbing, jumping, skiing etc. Such machines include treadmills, stepping machines, and various types of sliding machines. Elliptical exercise machines have also proven to be popular exercise products.

Elliptical exercise devices provide a lower impact exercise than some alternative exercise devices such as treadmills, or the like. Elliptical exercise devices additionally provide exercise for a wide range of motion. However, typical elliptical exercise machines can be somewhat inflexible. In particular, forces applied on existing elliptical exercise devices are commonly rigidly channeled into the elliptical movement of the foot supports along predefined elliptical paths. When a user shifts weight from one leg to the other leg energy is exerted on the elongate member configured to hold the user's weight. The inflexible nature of elongate members of typical elliptical devices results in the energy being relayed back to the legs and joints of the user. This creates an j alternating change in pressure between the user's legs which can result in impact on the user's joints.

BRIEF SUMMARY OF THE INVENTION

The present invention relates to elliptical exercise devices having a cushioning mechanism assembly configured to absorb energy during exercise. The cushioning mechanism assembly is configured to absorb energy exerted on one or more elongate members when the user's weight shifts from one leg to the other leg during exercise. In this manner, the impact on the user's joints is alleviated.

According to one aspect of the present invention, the cushioning mechanism assembly comprises first and second cushioning apparatuses. For example, in one embodiment each cushioning apparatus comprises a biasing apparatus. The biasing apparatus is coupled to an elongate member. The energy exerted on the elongate member is absorbed by the biasing apparatus. In one example, each biasing apparatus includes a spring element configured to absorb energy by undergoing elastic deformation.

According to another aspect of the present invention, the first and second cushioning apparatuses comprise first and second lever cushioning apparatuses. Each lever cushioning apparatus includes a lever arm and a cushioning element that functions as a fulcrum of the lever arm. The cushioning element is movable. The position of the cushioning element along the length of the elongate member affects the amount of cushioning provided by the cushioning element. By being movable, the cushioning element allows the user to select a desired amount of cushioning during exercise.

In one embodiment, the cushioning element includes a pair of pins that can be positioned in a plurality of slots along the length of the elongate member. In an alternative embodiment, the cushioning element includes a pair of flanges positioned on either side of the elongate member. The flanges permit the cushioning element to be slid along the length of the elongate member to reposition the cushioning element.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
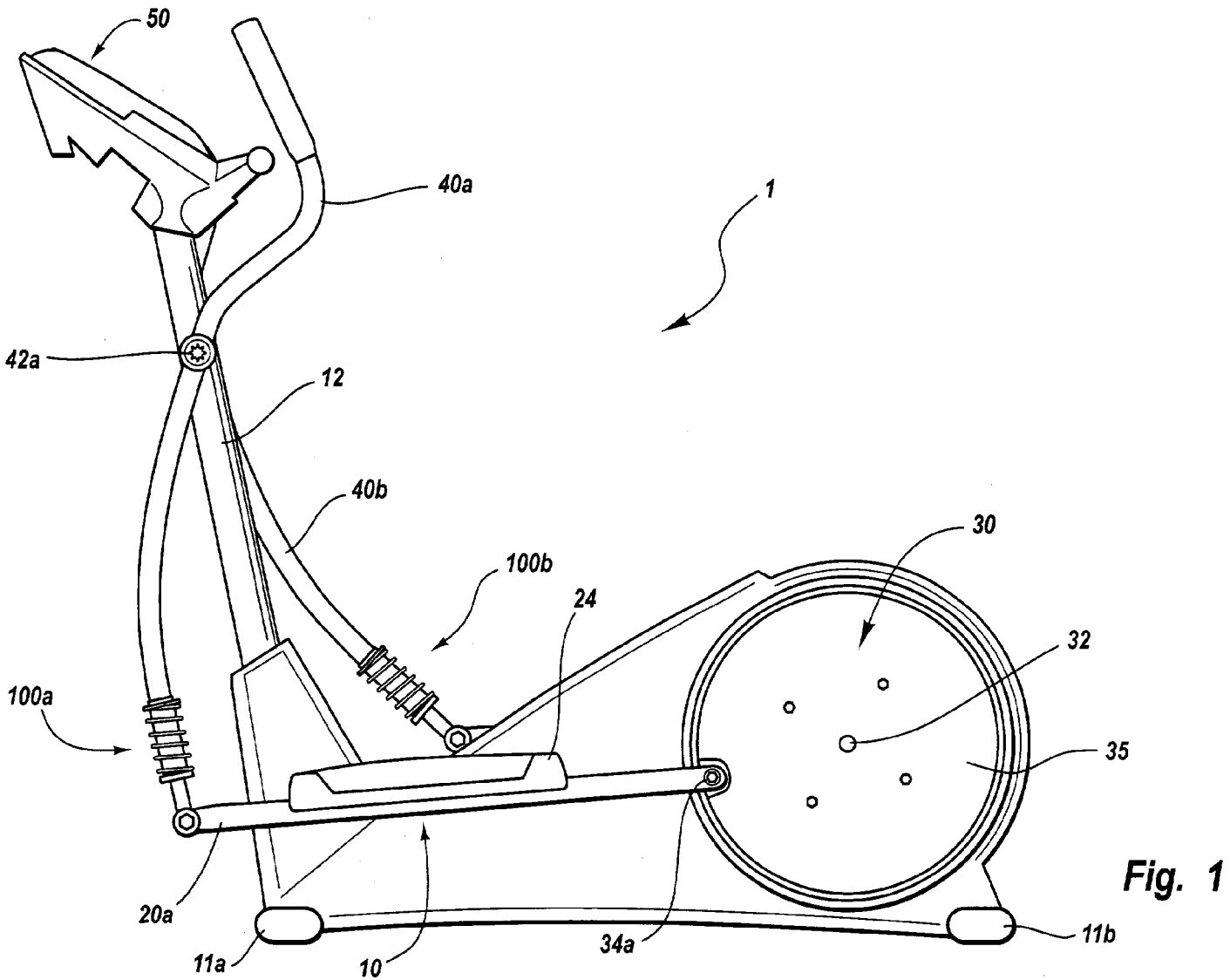
FIG. 1 illustrates a perspective view of an elliptical exercise device having a cushioning mechanism assembly according to one aspect of the present invention.
Figure 2:
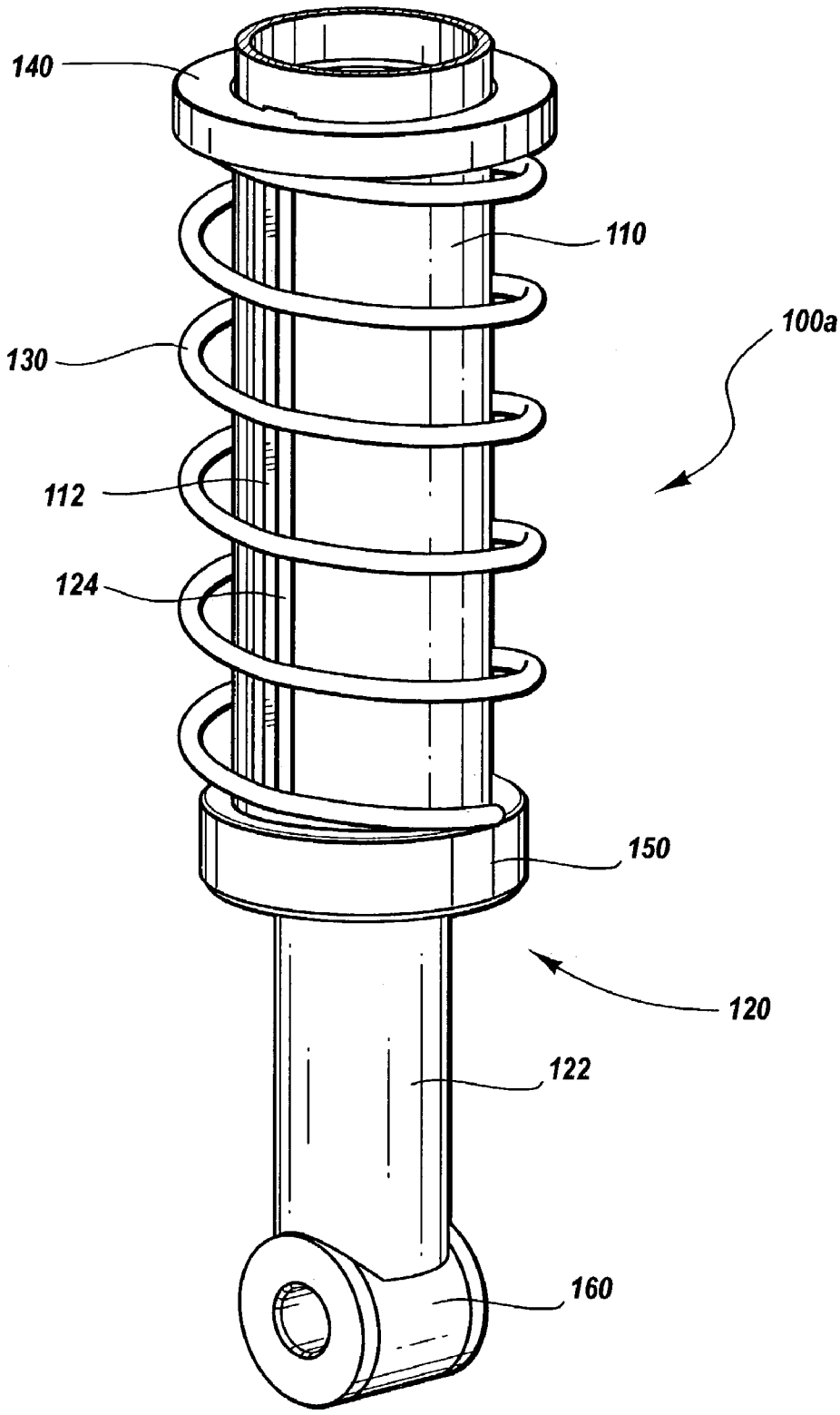
FIG. 2 is a perspective view of the biasing apparatus shown in the device of FIG. 1.
Figure 3:
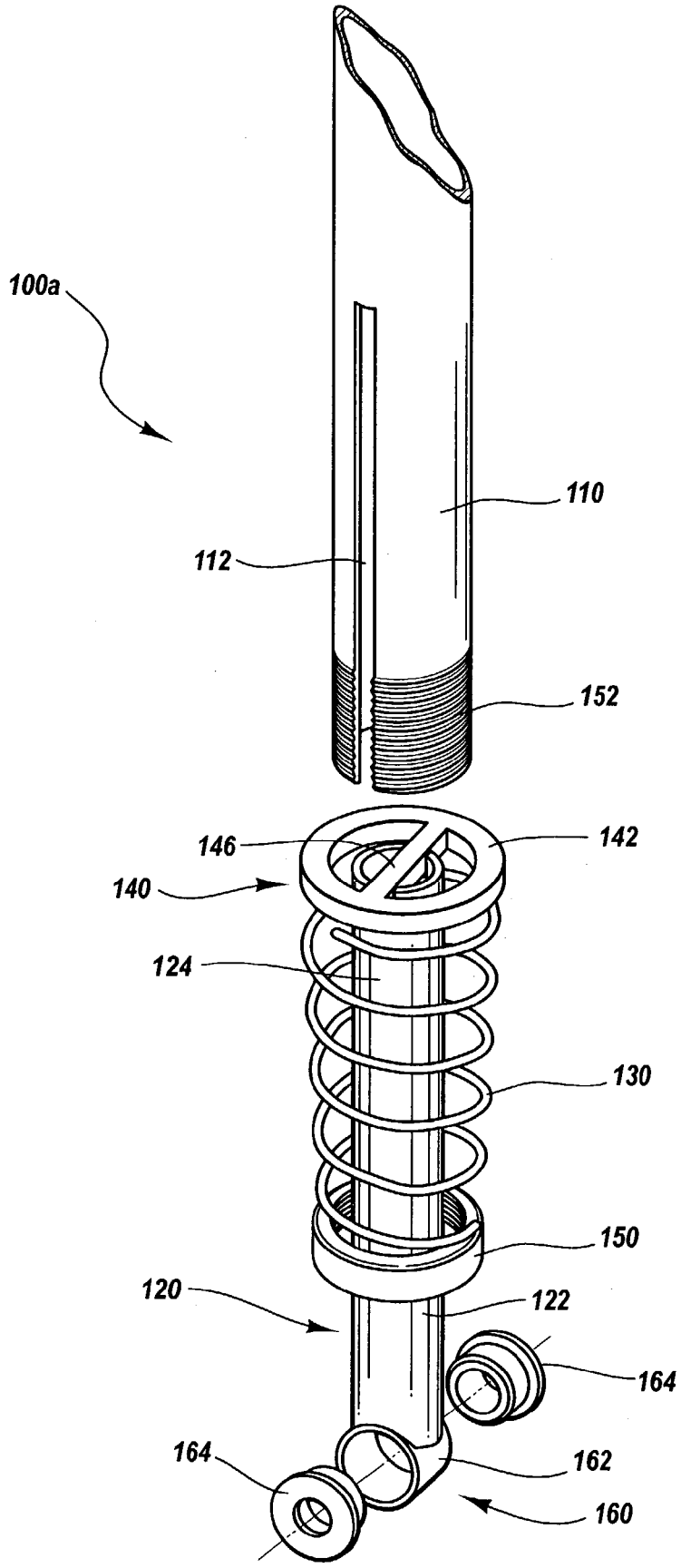
FIG. 3 is an exploded view of the biasing apparatus shown in the device of FIG. 1.
Figure 4:
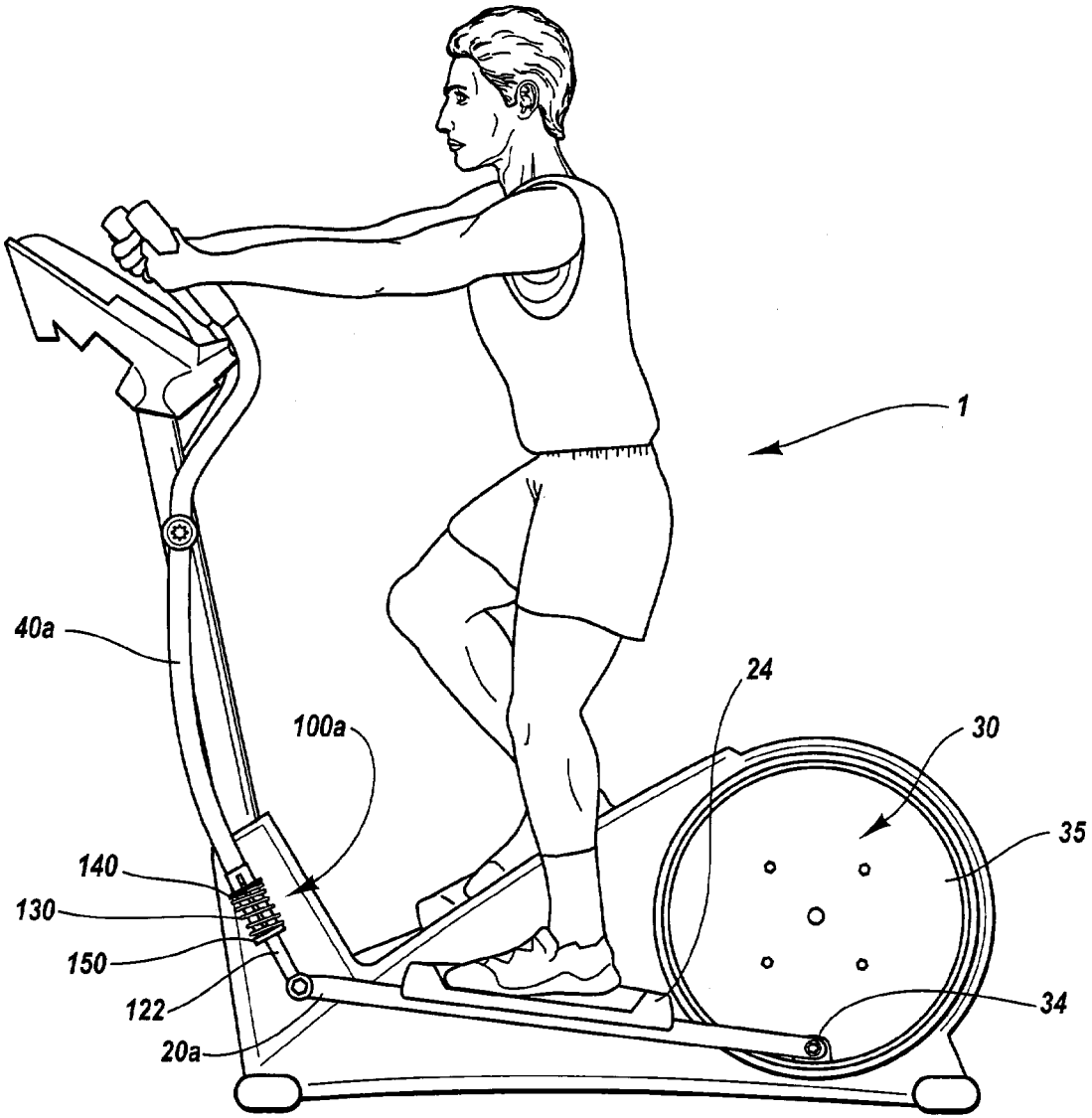
FIG. 4 is a perspective view of a user exercising on the cushioned elliptical exercise device of FIG. 1 illustrating the biasing apparatus in an elongate position.
Figure 5:
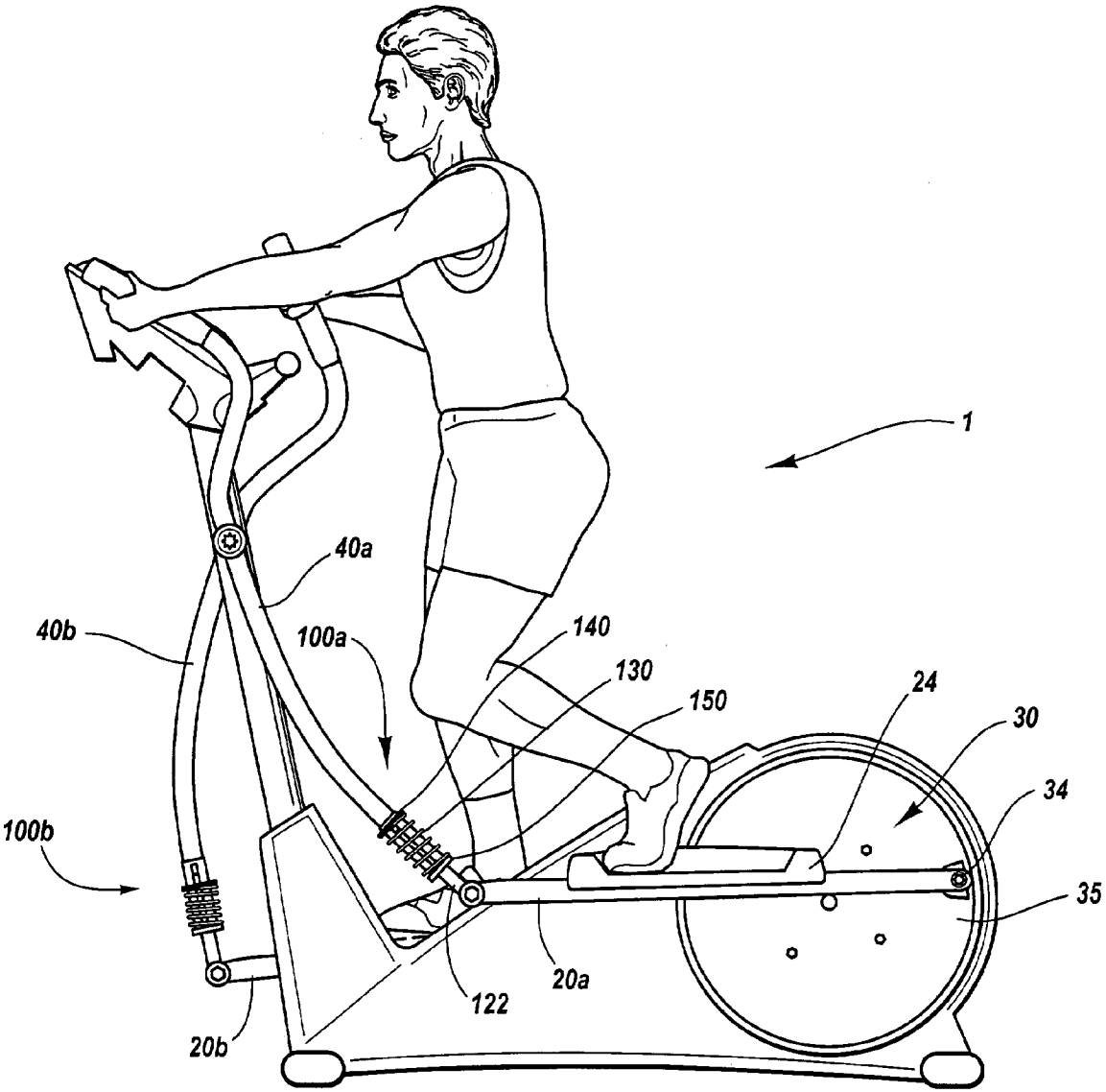
FIG. 5 is a perspective view of a user exercising on the cushioned elliptical exercise device of FIG. 4 illustrating one biasing apparatus in an elongate position and another mechanism in a compressed configuration.

FIG. 1 illustrates a perspective view of an elliptical exercise device 1 having a cushioning mechanism assembly according to one aspect of the present invention. FIG. 2 provides a close-up perspective view of the biasing apparatus 100*a* featured in FIG. 1. FIG. 3 is an exploded view of the biasing apparatus 100*a*. FIG. 4 is a perspective view of a user exercising on the cushioned elliptical exercise device when one biasing member 100*a* is in an elongate configuration and another biasing apparatus 100*b* is in a compressed configuration. FIG. 5 is a perspective view of a user exercising on the cushioned elliptical exercise device when one biasing member 100*a* is in an compressed configuration and another biasing apparatus 100*b* is in a elongate configuration.

Figure 6:
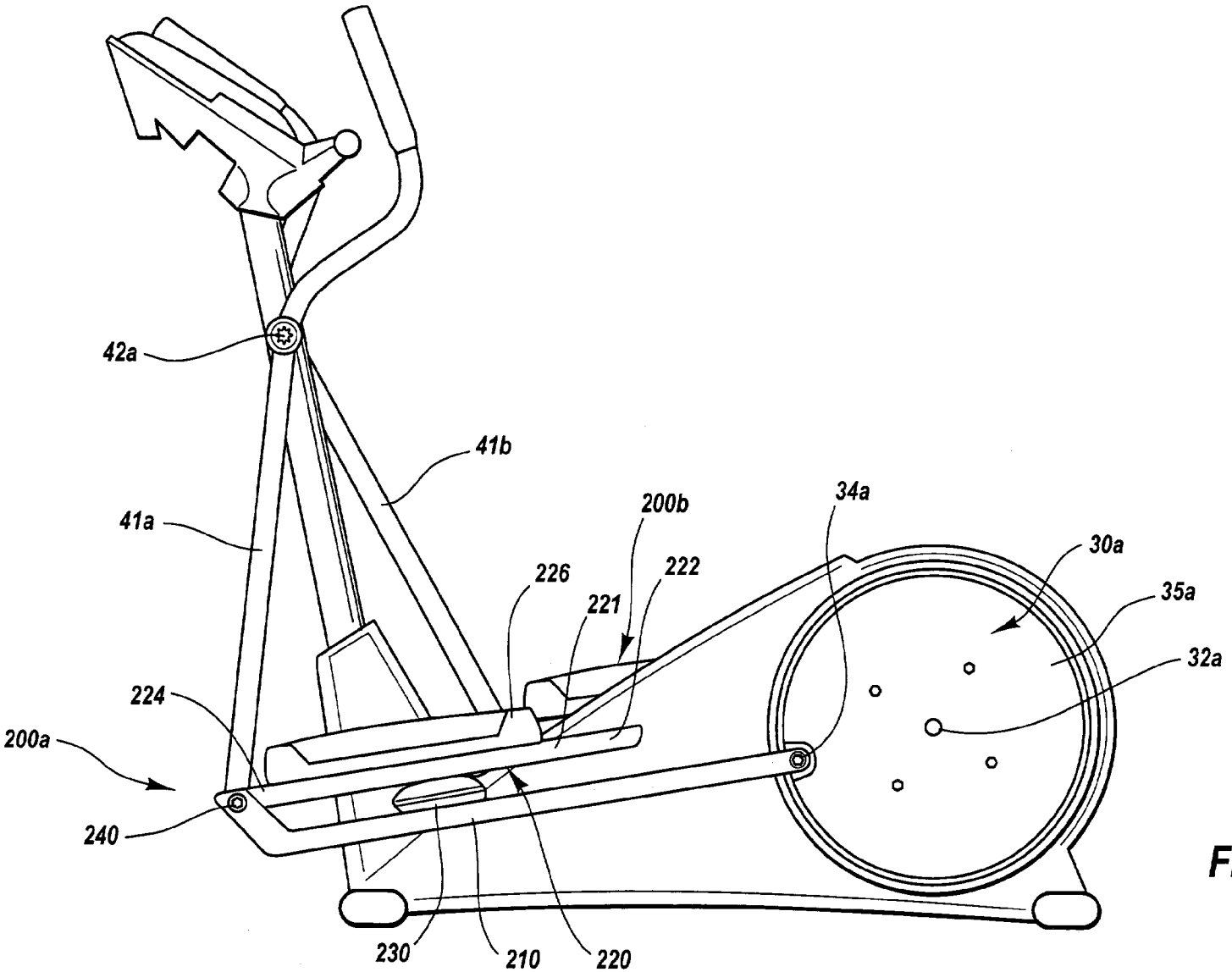
FIG. 6 is a perspective view of an elliptical exercise device having a lever cushioning apparatus according to another aspect of the present invention.
Figure 7:
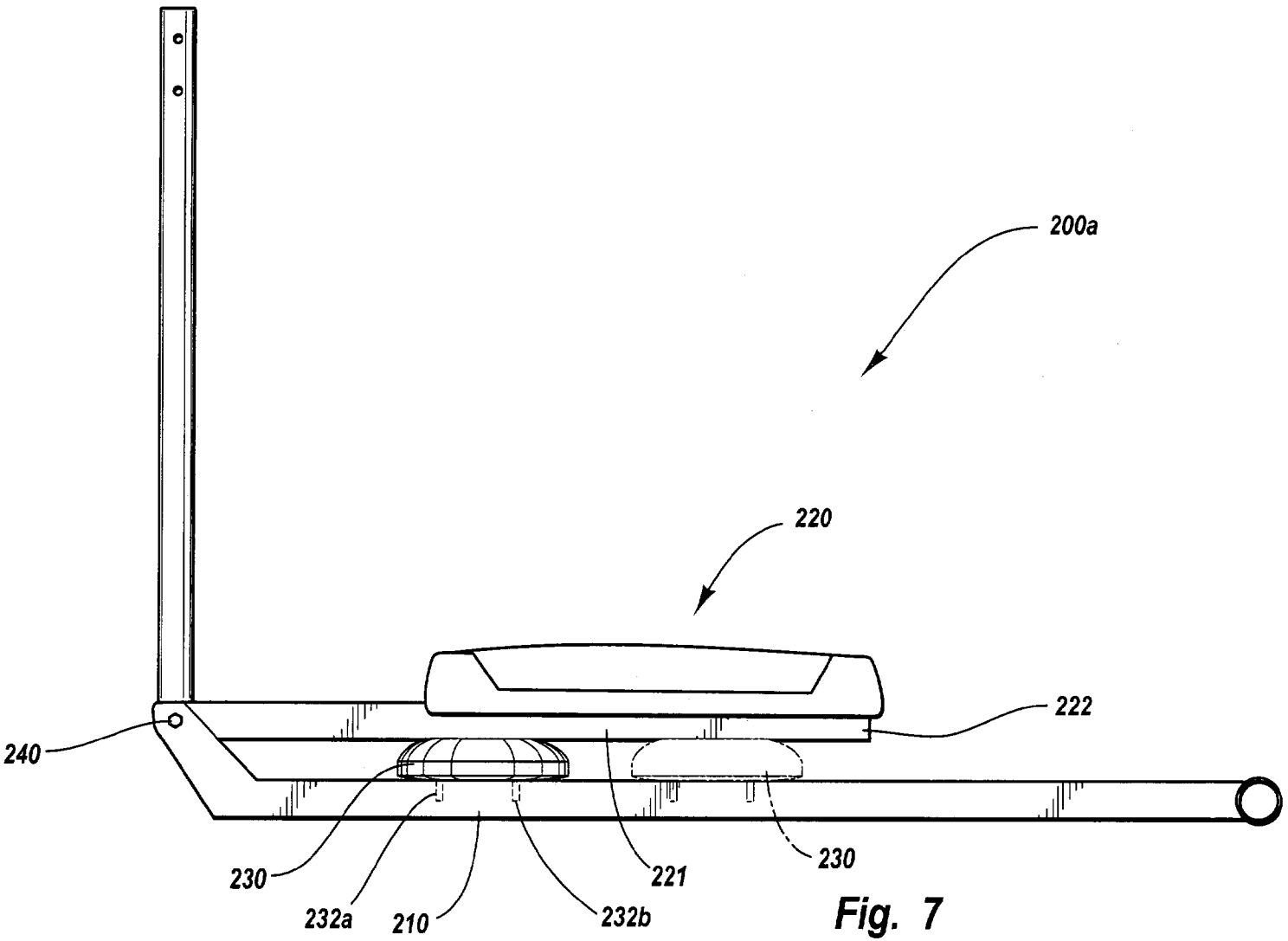
FIG. 7 is a view of the lever cushioning apparatus of FIG. 6 having a movable cushion element with an alternative position of the cushion element being shown in phantom lines.
Figure 8:
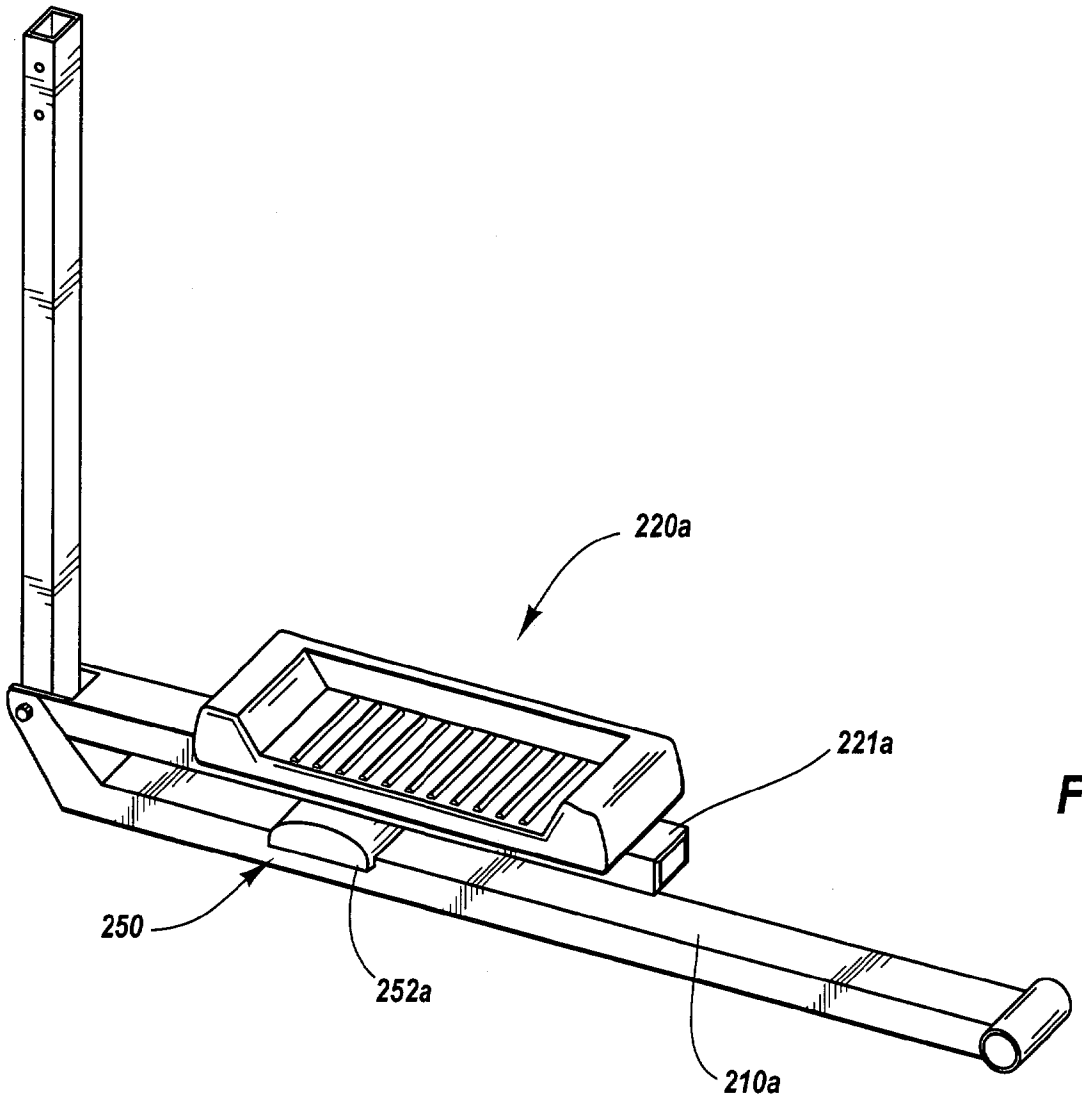
FIG. 8 is a view of the lever cushioning apparatus of FIG. 6 having an alternative movable cushion element that is movably coupled (e.g. slidably coupled) to the elongate member.

FIG. 6 is a perspective view of an elliptical exercise device 1*a* having a lever cushioning apparatus 200. FIG. 7 is a view of a movable cushion element 230 according to one aspect of the present invention. FIG. 8 is a view of an alternative movable cushion element 250.

With reference now to FIG. 1, cushioned elliptical exercise device 1 provides a mechanism for allowing a user to undertake an aerobic or anaerobic workout with minimal impact on the user's joints. The cushioned elliptical exercise device 1 includes a cushioning mechanism assembly that minimizes impact on the user's joints during exercise. The cushioning mechanism assembly comprises first and second cushioning apparatuses. In the illustrated embodiment the first and second cushioning apparatuses comprise respective first and second biasing apparatuses 100*a, b*.

In the illustrated embodiment cushioned elliptical exercise device 1 comprises a frame 10, first and second elongate members 20*a, b*, a rotating mechanism 30 (such as a crank), arm supports 40*a, b*, console 50, and biasing apparatuses 100*a, b*. Frame 10 includes an upright frame member 12 and front and rear stabilizing members 11*a*, 11*b*. Several of the components of cushioned elliptical exercise device 1 are coupled to and supported by upright frame member 12.

First and second elongate members 20*a,b* provide a support structure upon which the user's feet are positioned during exercise. Elongate members 20*a,b* are configured to move in an elliptical pattern providing the desired elliptical movement for exercise on the cushioned elliptical exercise device 1. The elliptical movement of elongate members 20*a,b* may include any closed loop movement such as, but not limited to, a generally circular movement, an ellipse, a loop that is longer than it is high, and/or a closed curve in the form of an oval.

In the illustrated embodiment, elongate members 20*a,b* comprise substantially planar rigid elements. However, a variety of types and configurations of elongate members can be utilized without departing from the scope and spirit of the present invention. For example, in one embodiment, the elongate members are comprised of a biasing spring member and/or may be curved to provide a desired configuration.

In the illustrated embodiment, elongate members 20*a,b* each have a foot support 24. Foot support 24 is adapted to accommodate a user's foot to maintain the position of user's foot during exercise. In an alternative embodiment, the elongate members are configured to accommodate a user's foot without the use a foot support.

Rotating mechanism 30 is coupled to frame 10 and elongate member 20. Rotating mechanism 30 facilitates elliptical movement of first and second elongate members 20*a, b*. In one embodiment the rotating mechanism comprises a crank. The crank has a center pivot axis 32 and horizontally oriented first and second pivot pins that are pivotally coupled to the rear end of each of the respective elongate members 20*a,b* providing a link to the frame. Center pivot axis 32 is the axis about which the crank rotates. In the illustrated embodiment, there is shown a single pivot pin 34*a*. A second pivot pin 34*b* (not shown) is provided on the opposite side of rotating mechanism 30 and is coupled to the rear end of elongate member 20*b*. The crank of FIG. 1 is substantially covered by a cosmetic cover 35 and/or flywheel coupled to the crank.

Descriptions of an illustrative rotating mechanism, frames, and/or elongate members that can be utilized in cushioned elliptical exercise device 1 are disclosed in U.S. patent application Ser. No. 09/943,741, filed on Aug. 30, 2001, which is incorporated herein by reference. As will be appreciated by those skilled in the art, a variety of types and configurations of rotating mechanisms 30 can be utilized without departing from the scope and spirit of the present invention. For example, in one embodiment, a rotating mechanism comprising a simple crank mechanism is utilized. Optionally, a flywheel may be coupled to the crank. In another embodiment, the rotating mechanism comprises a single rotating flywheel.

Arm supports 40*a,b* are movably coupled to frame 10 and are coupled to respective biasing apparatuses 100*a,b* thereby linking the respective biasing apparatuses 100*a,b* to the frame. Arm supports 40*a,b* also provide a mechanism allowing a user to support himself/herself while also providing a more complete workout routine. In the illustrated embodiment, arm supports 40*a,b* include respective arm support pivots 42*a,b* (pivot 42*b* not shown). Arm support pivots 42*a,b* provide a pivotal coupling between arm supports 40*a,b* and upright frame member 12.

A console 50 is coupled to upright frame member 12. A variety of types and configurations of console 50 can be utilized without departing from the scope and spirit of the present invention. For example, in one embodiment, console 50 can allow a user to input information about a desired workout program, physiological characteristics of the user, or the like.

Each biasing apparatus 100*a,b* is an example of a cushioning apparatus that can minimize impact on a user during exercise. Biasing apparatuses 100*a,b* alleviate pressure on the user's joints during movement of elongate members 20*a, b*. In the illustrated embodiment, each biasing apparatus 100*a,b* comprises a spring. First biasing apparatus 100*a* is coupled between elongate member 20*a* and arm support 40*a*. Second biasing apparatus 100*b* is coupled between elongate member 20*b* and arm support 40*b*. The upper portion of each biasing apparatus is integrally coupled to a respective arm support 40*a, b*. The lower portion of each biasing apparatus 100*a,b* is pivotally coupled to a respective elongate member 20*a, b*, facilitating elliptical movement of elongate members 20*a, b*.

With reference now to FIGS. 2 and 3, there is shown a perspective view of biasing apparatus 100*a* which may be the same or similar to biasing apparatus 100*b*. In the illustrated embodiment, biasing apparatus 100*a* is a shock absorption mechanism which comprises a slotted tubing element 110, a core member 120, a spring element 130, a flange 140 coupled to core member 120, a sleeve 150, and a pivotal coupling 160.

As will be discussed in detail below, upon placing pressure on an elongate member, core element 120 is moved downwardly, resulting in compression of spring element 130 between flange 140 (which moves within tubing element 110) and sleeve 150, which is affixed to tubing element 110. Biasing apparatus 100*a* thus provides a mechanism for alleviating pressure exerted on the first and second elongate members so as to alleviate pressure on a user's joints when the bulk of the user's weight shifts from one leg to the other leg. Biasing apparatus 100*a* is configured to undergo elongation and compression. Biasing apparatus 100*a* absorbs energy during elongation and relieves energy during compression.

Tubing element 110 comprises a stationary member to which other components of biasing apparatus 100*a* are coupled. The movable components of biasing apparatus 100 move relative to tubing element 110 during exercise. Tubing element 110 includes a slot 112. Slot 112 permits other movable components of biasing apparatus 100*a* to be secure while moving relative to tubing element 110. In the illustrated embodiment, each respective tubing element 110 is integrally coupled to the end of arm supports 40*a,b*. In alternative embodiments, tubing element 110 comprises a separate member from arm supports 40*a,b* and is either affixedly or moveably coupled thereto.

Core member 120 is partially positioned inside tubing element 110. Core member 120 moves relative to tubing element 110 such that biasing apparatus 100 is compressed and elongated. Core member 120 comprises an exposed end 122 and an enclosed end 124. Exposed end 122 is positioned external to tubing element 110. Enclosed end 124 is positioned internal to tubing element 110. The length of exposed end 122 and enclosed end 124 change during elongation and compression cycles. For example, during an elongation cycle, the length of exposed end 122 increases while the length of enclosed end 124 decreases. Similarly, during a compression cycle, the length of exposed end 122 decreases while the length of enclosed end 124 increases.

Spring element 130 is positioned external to tubing element 110 so as to circumscribe tubing element 110. Spring element 130 is configured to absorb energy exerted on elongate member 20*a,b*. Flange 140 is positioned above spring element 130. Flange 140 maintains the position of spring element 130 effectively preventing movement of spring element 130 past the upper end of tubing element 110. Flange 140 is movable relative to tubing element 110. By being movable, flange 140 compresses or allows elongation of spring element 130.

Sleeve 150 is threadably coupled to the end of tubing element 110. Sleeve 150 prevents movement of spring element 130 past the lower end of tubing element 110. Sleeve 150 is immovable relative to tubing element 110. As a result, as flange 140 moves closer towards sleeve 150, spring element 130 is compressed. As flange 140 moves further away from sleeve 150, the compressed spring element 130 is allowed to return to its original configuration. Pivotal coupling 160 is coupled to the end of core member 120. Pivotal coupling 160 pivotally couples biasing apparatus 100 to elongate member 28*a*. By providing a movable coupling between elongate member 20*a* and biasing apparatus 100*a*, pivotal coupling 160 facilitates the desired elliptical motion of elongate member 20*a*.

With reference now to FIG. 3, there is shown an exploded view of biasing apparatus 100*a* illustrating the manner in which the components of biasing apparatus 100*a* allow compression and elongation of spring element 130. Slot 112 of tubing element 110 provides a channel through tubing element 110 in which a component of flange 140 is positioned.

Flange 140 comprises a circumferential member 142 and a center support 146 connected thereto. A center portion of support 146 is mounted onto core member 120. Circumferential member 142 is configured to circumscribe tubing element 110. The outer edges of center support 146 are positioned in slot 112 and an opposing slot (not shown) in tubing element 110. The configuration of circumferential member 142 and center support 146 ensures uninterrupted movement of flange 140, as flange 140 moves up and down relative to sleeve 150.

Core member 120 is adapted to be coupled to flange 140. As pressure is exerted on core member 120, core member 120 slides inside tubing element 110 resulting in movement of flange 140. As previously discussed, sleeve 150 prevents movement of spring element 130 past the end of tubing element 110. In the illustrated embodiment, sleeve 150 has threads which permit sleeve 150 to be coupled to tubing element 110. Threads 152 are positioned on tubing element 110 to facilitate threaded coupling of tubing element 110 and sleeve 150.

The configuration of threads 152 and sleeve 150 allow the user to adjust the amount and characteristics of cushioning provided by biasing apparatus 100*a*. Threads 152 allow sleeve 150 to be positioned closer to uppermost position of flange 140, thus pretensioning spring element 130. By increasing the amount of pretensioning on spring element 130 a more rigid shock absorption, having a short range of motion, is provided. As will be appreciated by those skilled in the art, a variety of types and configurations of flange 140 and sleeve 150 can be provided without departing from the scope and spirit of the present invention. For example, in one embodiment, flange 140 is adjustable to pretension spring element 150. In another embodiment, sleeve 150 utilizes detent pins to be adjustably coupled to tubing element 110.

Pivotal coupling 160 is coupled to the exposed end 122 of core member 120. Pivotal coupling 160 comprises a pivot housing 162 and first and second bushings 164 that are mounted therein. Pivotal coupling 160 is coupled to elongate member 20*a* and allows rotation of elongate member 20*a* relative to biasing apparatus 100.

With reference now to FIGS. 2–4, there is shown the configuration of biasing apparatuses 100*a* when the weight of the user is exerted on elongate member 20*a* resulting in an elongate configuration of biasing apparatus 100*a*. As a user exercises, the user's weight shifts from one leg to the other. As the user's weight shifts from one leg to the other, pressure is exerted alternatively between elongate member 20*a* and elongate member 20*b*. When pressure is exerted on an elongated member, the pressure is conveyed to core member 120. As the pressure exerted downward on elongate member 20*a* exceeds the resistance provided by spring element 130, core member slides downward relative to tubing element 110. Because flange 140 is coupled to core member 120, flange 140 slides towards sleeve 150.

As mentioned above, movement of flange 140 in the direction of sleeve 150 results in compression of spring element 130 between flange 140 and sleeve 150. As spring element 130 is compressed, the elastic deformation undergone by spring element 130 absorbs the energy resulting from the downward movement of user's leg. By absorbing the energy, pressure on a user's joint is alleviated as the bulk of the user's weight shifts onto the leg associated with elongate member 20*a*.

With reference now to FIG. 5, there is shown the configuration of biasing apparatus 100*a* during upward movement of the user's foot on elongate member 20*a* resulting in a compressed configuration of biasing apparatus 100*a*. As the elliptical path of elongate member 20*a* moves towards the rear of rotating mechanism 30, the user's foot begins to move in an upward direction and the weight is shifted from the user's foot positioned on elongate member 20*a* to the user's foot positioned on elongate member 20*b*. As the weight is removed from elongate member 20*a*, the pressure exerted by spring element 130 on flange 140 exceeds the downward force exerted on core member 120. As this occurs, spring element 130 biases flange 140 upward. The exposed end 122 of core member 120 shortens as a portion of core member 120 is retracted into tubing element 110 resulting in a compressed configuration of biasing apparatus 100*a*.

With reference now to FIG. 6, there is shown a cushioned elliptical exercise device 1*a* having an alternative cushioning mechanism assembly. The cushioning mechanism assembly comprises first lever cushioning apparatus 200*a* and second lever cushioning apparatus 200*b*. Each lever cushioning apparatus is adapted to alleviate pressure on a user's joints when the bulk of the user's weight shifts from one leg to another.

First lever cushioning apparatus 200*a* may be the same or similar to the second lever cushioning apparatus 200*b* which is positioned on the side opposite first lever cushioning apparatus 200*a*. Lever cushioning apparatus 200*a* is adjustably linked to at least one of elongate member 210 and arm support 41*a* at a pivot point. Lever cushioning apparatus 200*a* comprises a foot support 220 and cushioning element 230. Elongate member 210 is coupled to arm support 41*a* at lever pivot 240. Elongate member 210 is coupled to rotating mechanism 30*a* (e.g. a crank) at elongate member pivot pin 34*a*.

Foot support 220 comprises a lever arm 221. Lever arm 221 has a first end 222 and a second end 224. In the illustrated embodiment foot support 220 further comprises a foot engagement member 226. Lever arm 221 is coupled to arm support 41*a* and elongate member 210 at lever pivot 240. Lever pivot 240 comprises a pivot mechanism such as a pivot pin, a bolt, a hinge, or another mechanism allowing pivoting of lever arm 221. Lever arm 221 moves in an elliptical path cooperatively with elongate member 210. First end 222 of lever arm 221 can be grasped and raised relative to elongate member 210. Second end 224 is coupled to arm support 41*a* and elongate member 210 at lever pivot 240.

Foot engagement member 226 is positioned on the upper surface of lover arm 221. Foot engagement member 226 limits movement of a user's foot during exercise. Cushioning element 230 is adjustably positioned between elongate member 210 and foot link-suppport 220. Cushioning element 230 absorbs energy so as to alleviate pressure on a user's joints when the bulk of the user's weight shifts from one let to the other leg.

The amount of cushioning, and the ability to absorb energy, provided by foot support 220 is dependent on the position of cushioning element 230 relative to first end 222 and second end 224 of lever arm 221. Variable cushioning is provided as a result of the lever arrangement of lever arm 221 relative to elongate member 210 and the position of cushion element 230. In the illustrated embodiment, cushioning element 230 comprises the fulcrum of the lever. The positioning of cushioning element 230 along the length of elongate member 210 results in greater or lesser energy being exerted on cushioning element 230.

When cushioning element 230 is positioned near first end 222 of lever arm 221, a smaller amount of love rage is exerted on cushioning clement 230 than when cushioninig element 230 is positioned near second end 224 of lever arm 221. When a greater amount of pressure is exerted on cushioning element 230, cushioning element 230 undergoes a greater uniount of deformation than when a smaller amount of pressure is exerted on cushioning element 230. Additionally, when cushioning element 230 undergoes a greater amount of defonnation, cushioning element 230 absorbs a greater amount of energy from the impact of user's foot. When cushioning element 230 is positioned near second end 224, deformation of cushioning element 230 results in a greater amount of movement of foot engagement member 226 than when cushioning element is positioned near first end 222. This increases the range of movement of lever arm 221 during which energy is being absorbed by cushioning element 230. The adjustability of cushion elenient 230 relative to lever arm 221 can be achieved utilizing a variety of different methods and utiliAng a variety of mechanisms without departing from the scope and spirit of the present invention. undergoes a greater amount of deformation, cushioning element 230 absorbs a greater amount of energy from the impact of user's foot. When cushioning element 230 is positioned near second end 224, deformation of cushioning element 230 results in a greater amount of movement of foot engagement member 226 than when cushioning element is positioned near first end 222. This increases the range of movement of lever arm 221 during which energy is being absorbed by cushioning element 230. The adjustability of cushion element 230 relative to lever arm 221 can be achieved utilizing a variety of different methods and utilizing a variety of mechanisms without departing from the scope and spirit of the present invention.

By providing a mechanism that allows a user to change the position of cushioning element 230, a user can select a greater or lesser amount of cushioning to be provided by cushioning element 230. This allows a user to tailor the amount of cushioning to the desired characteristics of the workout. For example, a user may desire a greater amount of cushioning for a particularly long workout. Alternatively, a user may desire a lesser amount of cushioning during a rigorous workout of short duration.

With reference now to FIG. 7, foot support 220 and elongate member 210 of FIG. 6 are shown. Cushioning element 230 includes first and second pins 232*a,b* adjustability mounted in elongate member 210. A plurality of apertures are positioned along the length of elongate member 210 to accommodate first and second pins 232*a,b*. In order to move the position of cushioning element 230, the user raises first end 222 of lever arm 221, lifts cushioning element 230 such that pins 232*a,b* are removed from the apertures, and repositions cushioning element 230 on elongate member 20*a* (such as to the position shown in phantom lines) such that pins 232*a,b* are placed in new apertures along the length elongate member 210.

FIG. 8 shows an alternative mechanism for providing a movable cushion 250, according to another aspect of the present invention. Movable cushion 250 is slidably coupled to elongate member 210*a*. In the illustrated embodiment, cushioning element 250 includes a pair of flanges 252*a,b* (252*b* not shown) positioned on opposing sides of elongate member 210*a*. Flanges 252*a,b* prevent lateral movement of cushioning element 250 to maintain the position of cushioning element 250 on elongate member 210*a*. Additionally, flanges 252*a,b* permit the user to slide cushioning element 250 along the length of elongate member 210*a*. In order to change the position of cushioning element 250, the user can elevate lever arm 221*a*, then slide cushioning element 250 until a desired position is achieved. In one embodiment the user can slide cushion element 250 without raising lever arm 221*a*. Cushioning element 250 is thus movably coupled to elongate member. Other examples of movable coupling include, but are not limited to, a cushioning element that is rollably coupled to elongate member.

As will be appreciated by those skilled in the art, a variety of types and configurations of elliptical exercise devices can be utilized without departing from the scope and spirit of the present invention. For example, in one embodiment a first and second biasing apparatus are positioned on either end of each elongate member. In an alternative embodiment, a biasing apparatus uses an elastic member that absorbs energy during elongation. In yet another alternative embodiment, different types of cushioning mechanism assemblies are used cooperatively to absorb energy during exercise.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A cushioned elliptical exercise device comprising:

a frame;

first and second elongate members linked to the frame; and a cushioning mechanism assembly linked to at least one of the first or second elongate members, the cushioning mechanism assembly comprising a cushioning element linked to and movable along a length of at least one of the first or second elongate members, wherein the elongate members each engage in an elliptical movement and the cushioning mechanism assembly absorbs energy exerted on at least one of the first or second elongate members during exercise.

2. The cushioning elliptical exercise device of claim 1, further comprising a second cushioning mechanism assembly comprising a second cushioning element.

3. The cushioned elliptical exercise device of claim 2, wherein the first cushioning apparatus is linked to the first elongate member and the first cushioning element is movably counted to the first elongate member, and wherein the second cushioning member is linked to the second elongate member and the second cushioning element is movably coupled to the second elongate member.

4. The cushioned elliptical exercise device of claim 3, wherein each of the first and second biasing apparatuses comprise a resilient member.

5. The cushioned elliptical exercise device of claim 1, wherein the cushioning mechanism assembly comprises first and second lever cushioning apparatuses.

6. The cushioned elliptical exercise device of claim 5, wherein the first lever cushioning apparatus is coupled to the first elongate member and the second lever cushioning apparatus is coupled to the second elongate member.

7. A cushioned elliptical exercise device comprising:

a frame;

first and second elongate members movably linked to the frame such that flue elongate members each engage in a elliptical movement; and first and second lever cushioning apparatuses linked to respective first and second elongate members, wherein the first lever cushioning apparatus comprises a cushioning element movable along at least a part of a length of the first elongate member, and wherein the first and second lever cushioning apparatuses alleviate pressure on a user's joints during exercise.

8. The cushioned elliptical exercise device of claim 7, wherein the lever cushioning apparatuses are coupled to at least one of (i) respective arm support assemblies; or (ii) respective elongate members.

9. The cushioned elliptical exercise device of claim 8, wherein each of the first and second lever cushioning apparatuses comprise a lever arm and a cushioning element.

10. A cushioned elliptical exercise device comprising:

a frame;

first and second elongate members movably linked to the frame such that the elongate members each engage in a elliptical movement; and first and second lever cushioning apparatuses linked to respective first and second elongate members, wherein the first lever cushioning apparatus comprises a cushioning element movable along at least a part of a length of the first lever cushioning apparatus, and wherein the first and second lever cushioning apparatuses alleviate pressure on a user's joints during exercise, wherein the lever cushioning apparatuses are coupled to at least one of (i) respective arm support assemblies; or (ii) respective elongate members, wherein each of the first and second lever cushioning apparatuses comprise a lever arm and a cushioning element, and wherein each of the first and second lever cushioning apparatuses includes a foot support for accommodating a user's foot.

11. The cushioned elliptical exercise device of claim 9, wherein the cushioning element function as a fulcrum of the lever arm.

12. The cushioned elliptical exercise device of claim 11, wherein at least one of the first and second lever cushioning apparatuses is pivotally coupled to one or more elongate members utilizing a lever pivot.

13. The cushioned elliptical exercise device of claim 11, wherein the cushioning element is positioned adjacent one or more elongate members.

14. A cushioned elliptical exercise device comprising:

a frame;

first and second elongate members movably linked to the frame such that the elongate members each engage in a elliptical movement; and first and second lever cushioning apparatuses linked to respective first and second elongate members, wherein the first and second lever cushioning apparatuses alleviate pressure on a user's joints during exercise, wherein the lever cushioning apparatuses are coupled to at least one of (i) respective arm support assemblies; or (ii) respective elongate members, wherein each of the first and second lever cushioning apparatuses comprise a lever arm and a cushioning clement, wherein each cushioning element functions as a fulcrum of the respective lever arm, wherein the cushioning element is positioned adjacent one or more elongate members, and wherein the cushioning element is movable along at least part of a length of the elongate member.

15. A cushioned elliptical exercise device comprising:

a frame;

first and second elongate members movably linked to the frame such that the elongate members each engage in a elliptical movement; and first and second lever cushioning apparatuses linked to respective first and second elongate members, wherein the first and second lever cushioning apparatuses alleviate pressure on a user's joints during exercise, wherein the lever cushioning apparatuses are coupled to at least one of (i) respective arm support assemblies; or (ii) respective elongate members, wherein each of the first and second lever cushioning apparatuses comprise a lever arm and a cushioning element, wherein each cushioning element functions as a fulcrum of the respective lever arm, wherein the cushioning element is positioned adjacent one or more elongate members, wherein the cushioning element is movable along at least part of a length of the elongate member, and wherein the amount of cushioning provided, and the amount of energy absorbed by, the cushioning element is dependent on the position of the cushioning element along the length of the one or more elongate members.

16. A cushioned elliptical exercise device comprising;

a frame;

first and second elongate members movably linked to the frame such tat the elongate members each engage in a elliptical movement; and first and second lever cushioning apparatuses linked to respective first and second elongate members, wherein the first and second lever cushioning apparatuses alleviate pressure on a user's joints during exercise, wherein the lever cushioning apparatuses are coupled to at least one of (i) respective arm support assemblies; or (ii) respective elongate members, wherein each of the first and second lever cushioning apparatuses comprise a lever arm and a cushioning element, wherein each cushioning element functions as a fulcrum of the respective lever arm, wherein the cushioning element is positioned adjacent one or more elongate members, wherein the cushioning element is movable along at least part of a length of the elongate member, wherein the amount of cushioning provided, and the amount of energy absorbed by, the cushioning element is dependent on the position of the cushioning element along the length of the one or more elongate members, end wherein the cushioning element allows a user to select a greater or lesser amount of cushioning to achieve a desired amount of cushioning.

17. A cushioned elliptical exercise device comprising:

a frame;

a rotating mechanism coupled to the frame;

first and second elongate members coupled to the rotating mechanism; and first and second cushioning apparatuses linked to the respective first and second elongate members and to the frame, the elongate members each engaging in an elliptical movement, wherein each of the first and second cushioning apparatuses comprise a cushioning member movable along at least a part of a length of the respective elongate member to alleviate pressure on a user's joints during exercise, wherein the amount of cushioning provided is dependent upon the position of the movable cushioning member.

18. The cushioned elliptical exercise device of claim 17, wherein each of the first and second elongate members comprise a front end and an cmprising rear end, wherein the rotating mechanism is coupled to rear ends of the respective first and second elongate members.

19. The cushioned elliptical exercise device of claim 17, wherein the elongate members each include foot supports to maintain the position of the user's feet during exercise.

20. The cushioned elliptical exercise device of claim 17, further comprising first and second arm supports.

21. A cushioned elliptical exercise device comprising:

a frame;

a rotating mechanism coupled to the frame;

first and second arm supports pivotally coupled to the frame;

first and second elongate members movably coupled to respective first and second arm supports and to the rotating mechanism such that the elongate members each engage in a elliptical movement, wherein each of the first and second elongate members comprise a front end and an opposing rear end; and first and second lever cushioning apparatuses pivotally coupled to at least one of (i) respective first and second elongate members; or (ii) respective first and second arm supports, wherein the first lever cushioning apparatus comprises a first lever arm and a movable cushioning element positioned between the first lever arm and the first elongate member allowing a user to select a greater or lesser amount of cushioning, and wherein the first and second lever cushioning apparatuses alleviate pressure on a user's joints during exercise.

22. The cushioned elliptical exercise device of claim 21, wherein the rotating mechanism is coupled to rear ends of the respective first and second elongate members.

23. The cushioned elliptical exercise device of claim 21, wherein the first and second arm supports are coupled to front cads of the respective first and second elongate members and the first and second lever cushioning apparatuses are pivotally coupled to respective first and second elongate members.

24. A cushioned elliptical exercise device comprising:

a frame;

a rotating member coupled to the frame;

first and second arm supports pivotally coupled to the frame;

first and second elongate members movably coupled to respective first and second arm supports and to the rotating member, wherein each of the first and second elongate members comprise a front end and an opposing rear end; and first and second biasing apparatuses linked to the front ends of the respective first and second elongate members and to the respective first and second arm supports, the elongate members each engaging in an elliptical movement, wherein the first and second biasing apparatuses each comprise a cushioning member movable along at least a part of a length of the respective first and second elongate members to alleviate pressure on a user's joints during exercise.

25. The cushioned elliptical exercise device of claim 24 wherein the rotating member is coupled to rear ends of the respective first and second elongate members.

26. The cushioned elliptical exercise device of claim 25, wherein the first and second biasing apparatuses are coupled to the front ends of the respective first and second elongate members.

27. A cushioned elliptical exercise device comprising:

a frame;

first and second elongate members linked to the frame; and a cushioning mechanism assembly linked to at least one of the first or second elongate members, the cushioning mechanism assembly comprising a cushioning element movable along at least a part of a length of the at least one of the first or second elongate members, wherein the elongate members each engage in an elliptical movement and the cushioning mechanism assembly absorbs energy exerted on at least one of the first or second elongate members during exercise.

28. The cushioned elliptical exercise device of claim 27, further comprising a rotating mechanism coupled to the frame.

29. The cushioned elliptical exercise device of claim 28, wherein the first and second elongate members are coupled to the rotating mechanism.

30. The cushioned elliptical exercise device of claim 27, wherein each of the first and second elongate members include a foot support to maintain the position of the user's feet during exercise.

* * * * *

UNITED STATES PATENT AND TRADEMARK OFFICE

CERTIFICATE OF CORRECTION

PATENT NO. : 7,169,087 B2 
APPLICATION NO. : 10/369207
DATED : January 30, 2007
INVENTOR(S) : Ercanbrack et al.

It is certified that error appears in the above-identified patent and that said Letters Patent is hereby corrected as shown below:

Title Page

(56) References Cited, change "Soderberg" to --Soderberg, Sr.--

Drawings

Sheet 4, FIG. 4, please replace the current drawing for FIG. 4 with the figure depicted below in which "single pivot pin 34a" has been correctly labeled.

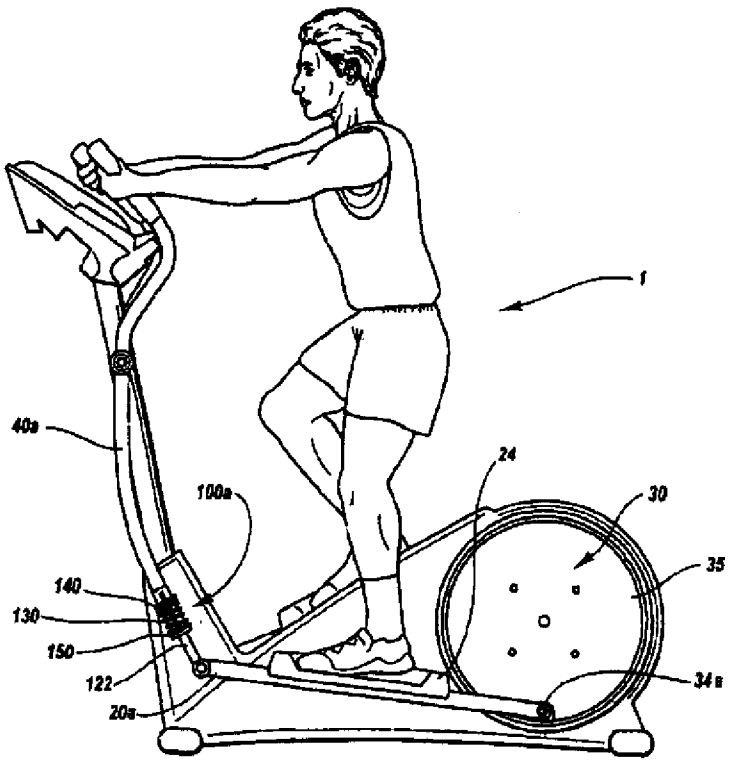

UNITED STATES PATENT AND TRADEMARK OFFICE

CERTIFICATE OF CORRECTION

PATENT NO. : 7,169,087 B2
APPLICATION NO. : 10/369207
DATED : January 30, 2007
INVENTOR(S) : Ercanbrack et al.

It is certified that error appears in the above-identified patent and that said Letters Patent is hereby corrected as shown below:

Sheet 5, FIG. 5, please replace the current drawing for FIG. 5 with the figure depicted below in which "single pivot pin 34a" has been correctly labeled.

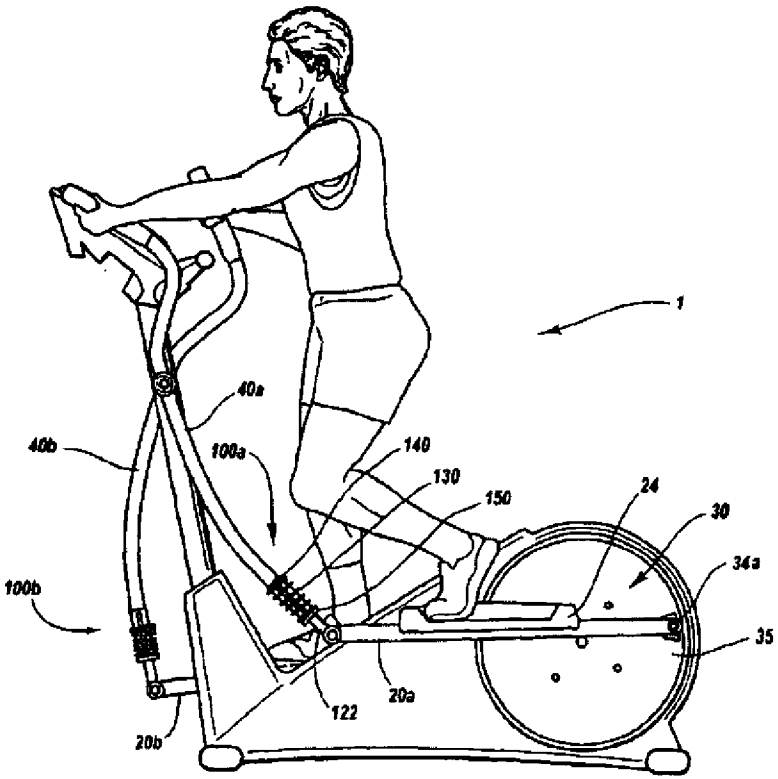

UNITED STATES PATENT AND TRADEMARK OFFICE

CERTIFICATE OF CORRECTION

PATENT NO. : 7,169,087 B2
APPLICATION NO. : 10/369207
DATED : January 30, 2007
INVENTOR(S) : Ercanbrack et al.

It is certified that error appears in the above-identified patent and that said Letters Patent is hereby corrected as shown below:

Column 1
Line 14, change “skiing etc.” to --skiing, etc.--
Line 31, change “an j alternating” to --an alternating--

Column 2
Line 58, change “member” to --apparatus--
Line 62, change “member” to --apparatus--
Line 62, change “an” to --a--
Line 63, change “a” to --an--
Line 66, change “200” to --200a--

Column 3
Line 40, change “of user’s” to --of the user’s--
Line 43, change “use a” to --use of a--
Line 45, change “member 20” to --members 20a, 20b--

Column 4
Line 46, change “element” to --member--
Line 60, change “100” to --100a--

Column 5
Line 5, change “100” to --100a--
Line 19, change “member” to --members--
Line 36, change “100” to --100a--
Line 36, change “28a” to --20a--

Column 6
Line 4, change “to uppermost” to --to the uppermost--
Line 14, change “element 150” to --element 130--
Line 21, change “100” to --100a--
Line 23, change “apparatuses” to --apparatus--
Line 33, insert --120-- after “member”
Line 42, change “of user’s” to --of a user’s--
Line 64, after “device” delete “1a”

UNITED STATES PATENT AND TRADEMARK OFFICE

CERTIFICATE OF CORRECTION

PATENT NO. : 7,169,087 B2
APPLICATION NO. : 10/369207
DATED : January 30, 2007
INVENTOR(S) : Ercanbrack et al.

It is certified that error appears in the above-identified patent and that said Letters Patent is hereby corrected as shown below:

Column 7
Line 29, change “lover” to --lever--
Line 32, change “link-support” to --support--
Line 35, change “let” to --leg--
Line 48, change “love rage” to --leverage--
Line 49, change “cushioninig” to --cushioning--
Line 53, change “uniount” to --amount--
Line 55, remove “undergoes a”
Lines 56-67, remove the entire lines Column 8
Line 1, remove “the present invention.”
Line 3, change “of user’s” to --of a user’s--
Line 7, change “element” to --element 230--
Line 33, change “20a” to --210--
Line 35, insert --of-- after “length”
Line 54, change “to elongate” to --to an elongate--

Column 9
Claim 3, line 24, change “apparatus” to --mechanism assembly--
Claim 3, line 26, change “counted” to --coupled--
Claim 3, line 27, change “member” to --mechanism assembly--
Claim 4, line 31, change “biasing apparatuses” to --mechanism assemblies--
Claim 7, line 43, change “flue” to --the--
Claim 7, line 44, change “a” to --an--
Claim 10, line 63, change “a” to --an--

Column 10
Claim 11, line 13, change “function” to --functions--
Claim 14, line 27, change “a” to --an--
Claim 14, line 36, change “clement” to --element--
Claim 15, line 47, change “a” to --an--

UNITED STATES PATENT AND TRADEMARK OFFICE

CERTIFICATE OF CORRECTION

PATENT NO. : 7,169,087 B2
APPLICATION NO. : 10/369207
DATED : January 30, 2007
INVENTOR(S) : Ercanbrack et al.

It is certified that error appears in the above-identified patent and that said Letters Patent is hereby corrected as shown below:

Column 11
Claim 16, line 2, change "tat" to --that--
Claim 16, line 2, change "a" to --an--
Claim 16, line 21, change "end" to --and--
Claim 18, line 42, change "cmprising" to --opposing--
Claim 21, line 58, change "a" to --an--

Column 12
Claim 23, line 11, change "cads" to --ends--

Signed and Sealed this

Twenty-second Day of December, 2009

David J. Kappos

David J. Kappos
*Director of the United States Patent and Trademark Office*